US006975190B2

(12) United States Patent
Sato et al.

(10) Patent No.: US 6,975,190 B2
(45) Date of Patent: Dec. 13, 2005

(54) CONTACTOR DEVICE OF CIRCUIT BREAKER

(75) Inventors: Akifumi Sato, Saitama (JP); Koji Asakawa, Saitama (JP); Mitsuhiro Mitsushige, Saitama (JP); Yasuhiro Takahashi, Saitama (JP); Hideto Yamagata, Saitama (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 10/939,373

(22) Filed: Sep. 14, 2004

(65) Prior Publication Data

US 2005/0184837 A1 Aug. 25, 2005

(30) Foreign Application Priority Data

Feb. 19, 2004 (JP) ..... 2004-042299

(51) Int. Cl.[7] ..... H01H 75/00
(52) U.S. Cl. ..... 335/16; 335/147; 335/195; 218/22
(58) Field of Search ..... 335/16, 147, 132, 335/195; 218/22

(56) References Cited

U.S. PATENT DOCUMENTS 3,506,937 A * 4/1970 Hanafusa ..... 335/16
3,560,683 A * 2/1971 Maier et al. ..... 218/21
3,614,687 A * 10/1971 Iida et al. ..... 335/195
4,417,223 A * 11/1983 Bancalari ..... 335/195
4,611,187 A * 9/1986 Banfi ..... 335/16
4,680,562 A * 7/1987 Bratkowski et al. ..... 335/16
4,945,326 A * 7/1990 Kandatsu ..... 335/16
5,184,099 A * 2/1993 DiMarco et al. ..... 335/16
5,502,428 A * 3/1996 McColloch et al. ..... 335/172
5,917,390 A * 6/1999 Papallo et al. ..... 335/16

FOREIGN PATENT DOCUMENTS

| | | |
|---|---|---|
| JP | 52-45164 | 3/1977 |
| JP | 3-34234 | 2/1991 |
| JP | 03-182028 | 8/1991 |
| JP | 4-190535 | 7/1992 |
| JP | 5-217489 | 8/1993 |
| JP | 6-52777 | 2/1994 |

* cited by examiner

*Primary Examiner*—Lincoln Donovan
(74) *Attorney, Agent, or Firm*—Manabu Kanesaka

(57) ABSTRACT

A contactor device of a repulsion-type circuit breaker includes a first movable contactor with a first movable contact to be driven by an open-close mechanism; a fixed contactor; a second movable contactor having second and third movable contacts; a first contact spring for urging the first movable contactor toward the second movable contactor; and a second contact spring for urging the second movable contactor toward the first movable contactor and the fixed contactor. The first movable contactor, fixed contactor, and second movable contactor are arranged such that when an over-current flows, an electromagnetic repulsive force is generated so that the first and second movable contactors are rotated against the first and second contact springs to open between the first movable contact and the second movable contact and between the fixed contact and the third movable contact before the open-close mechanism opens the first movable contact.

7 Claims, 3 Drawing Sheets

CONTACTOR DEVICE OF CIRCUIT BREAKER

BACKGROUND OF THE INVENTION AND RELATED ART STATEMENT

The present invention relates to a contactor device of a repulsion-type circuit breaker in which a movable contactor rotates with an electromagnetic repulsive force to open contacts.

A repulsion-type circuit breaker includes a double-break circuit breaker in which two movable contacts are separated simultaneously and a single-break circuit breaker in which one movable contact is separated. The double-break circuit breakers are disclosed in, for example, Japanese Patent Publications (Kokai) No. 06-52777 and No. 03-182028, and Japanese Utility Model Publication (Kokai) No. 52-45164. The single-break circuit breakers are disclosed in, for example, Japanese Patent Publications (Kokai) No. 04-190535 and No. 03-34234.

In the circuit breaker disclosed in Japanese Patent Publication (Kokai) No. 06-52777, an open-close mechanism drives a movable contactor having movable contacts at both ends to open and close, and the open-close mechanism needs to have high output power. In the circuit breaker disclosed in Japanese Patent Publication (Kokai) No. 03-182028, three movable contactors each having a movable contact at one end thereof are provided for performing the double-break operation, and a structure of the circuit breaker is complex and the contactor device occupies a large space in a height direction. In the circuit breaker disclosed in Japanese Patent Publication (Kokai) No. 52-45164, a movable contactor having movable contacts at both ends thereof and two movable contactors each having a movable contact at one end thereof are provided for performing the double-break operation. In the circuit breaker, the movable contactors with the movable contact at one end thereof are opened and closed in a vertical direction with the movable contactor having the movable contacts at both ends thereof interposed in between. Accordingly, the contactor device occupies a large space in a height direction and the circuit breaker has a large external dimension.

On the other hand, in the circuit breakers disclosed in Japanese Patent Publications (Kokai) No. 04-190535 and No. 03-34234, the single-break operation is performed, thereby obtaining inferior break performance as compared with the double-break circuit breaker.

In view of the problems described above, an object of the present invention is to provide a double-break contactor device having a simple structure, small size, and small load relative to an open-close mechanism.

Further objects and advantages of the invention will be apparent from the following description of the invention.

SUMMARY OF THE INVENTION

To attain the objects described above, according to a first aspect of the present invention, a contactor device of a repulsion-type circuit breaker includes a first movable contactor having a movable contact at one end thereof and rotatably supported with the other end thereof as a supporting point to be opened and closed by an open-close mechanism; a fixed contactor having a fixed contact at one end thereof and a terminal at the other end thereof; and a second movable contactor having a first movable contact for contacting the movable contact of the first movable contactor at one end thereof and a second movable contact for contacting the fixed contact of the fixed contactor at the other end thereof and rotatably supported between the first and second movable contacts. The first movable contactor is urged toward the second movable contactor by a contact spring, and the second movable contactor is urged toward the first movable contactor and the fixed contactor by a contact spring. When an over-current flows in a closed state, an electromagnetic repulsive force is generated between currents flowing through the first and second movable contactors and the fixed contactor. As a result, the first and second movable contactors rotate against the contact springs, so that the movable contact is separated from the first movable contact and the fixed contact is separated from the second movable contact before the open-close mechanism drives the first movable contactor to open.

In the first aspect of the invention, the first movable contactor is opened and closed by the open-close mechanism, and has the movable contact at the one end thereof and is rotatably supported at the other end thereof, thereby reducing a load relative to the open-close mechanism. The first movable contactor has the movable contact at the one end thereof, and the second movable contactor has the movable contacts at both ends thereof. Accordingly, the contactor device has a simple structure and does not occupy a large space in a height direction.

According to a second aspect of the present invention, it is preferable that the first and second movable contactors and the fixed contactor are arranged in an S-shape. With this structure, the electromagnetic repulsive force is generated between the contacts and between parallel conductor portions, thereby obtaining large driving force.

According to a third aspect of the present invention, the second movable contactor may be arranged such that the supporting point thereof is located at the center between the first and second movable contacts. With this structure, it is possible to decrease moment of inertia of the second movable contactor, thereby increasing an opening speed.

According to a fourth aspect of the present invention, the second movable contactor may be arranged such that the supporting point thereof is located closer to the second movable contact between the first and second movable contacts. With this structure, the second movable contact contacts with a force larger than that of the first movable contact. Accordingly, when the circuit breaker is closed in a normal state, it is possible to reduce an impact on the second movable contactor from the first movable contactor and prevent the second movable contact from moving upwardly away from the fixed contact.

According to a fifth aspect of the present invention, a long hole for loosely holding a supporting point shaft of the second movable contactor may be formed in a holding member holding the supporting point shaft that supports the second movable contactor. The long hole extends along a circular arc passing through the supporting point shaft around the second movable contact. With this structure, when the circuit breaker is closed in a normal state, it is possible to absorb an impact on the second movable contactor from the first movable contactor through a movement of the supporting point shaft in the long hole and prevent the second movable contact from moving upwardly away from the fixed contact.

According to a sixth aspect of the present invention, the second movable contactor may be provided with an auxiliary contact spring for pressing the second movable contact against the fixed contact. With the auxiliary contact spring, it is possible to prevent the second movable contact from moving upwardly due to the impact described above.

According to the invention, it is possible to make the double-break circuit breaker with superior breaking performance small and to reduce the load of the open-close mechanism similar to a single-break circuit breaker.

BRIEF DESCRIPTION OF THE DRAWINGS

FIGS. 1A and 1B are views showing a contactor device according to an embodiment of the present invention, wherein FIG. 1A is a side view thereof in a closed state, and FIG. 1B is a side view thereof in an open state;

DETAILED DESCRIPTION OF PREFERRED EMBODIMENTS

Figure 1A:
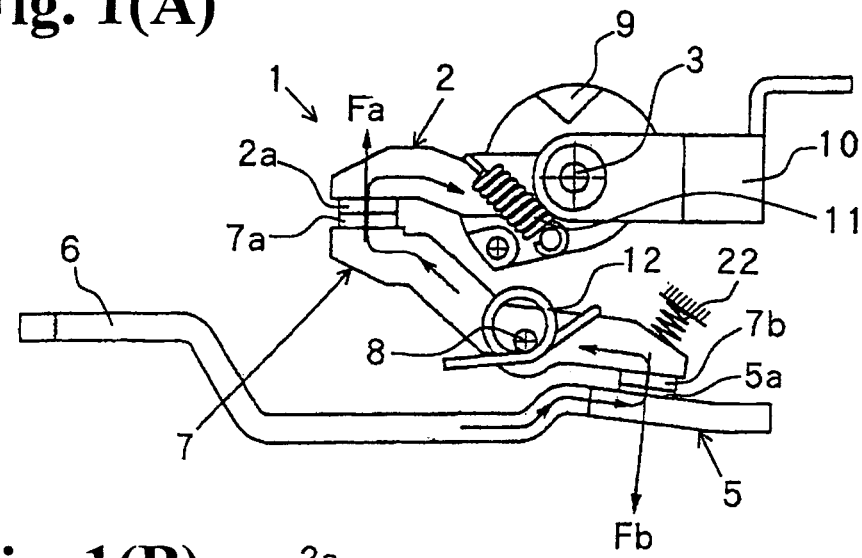
Figure 1B:
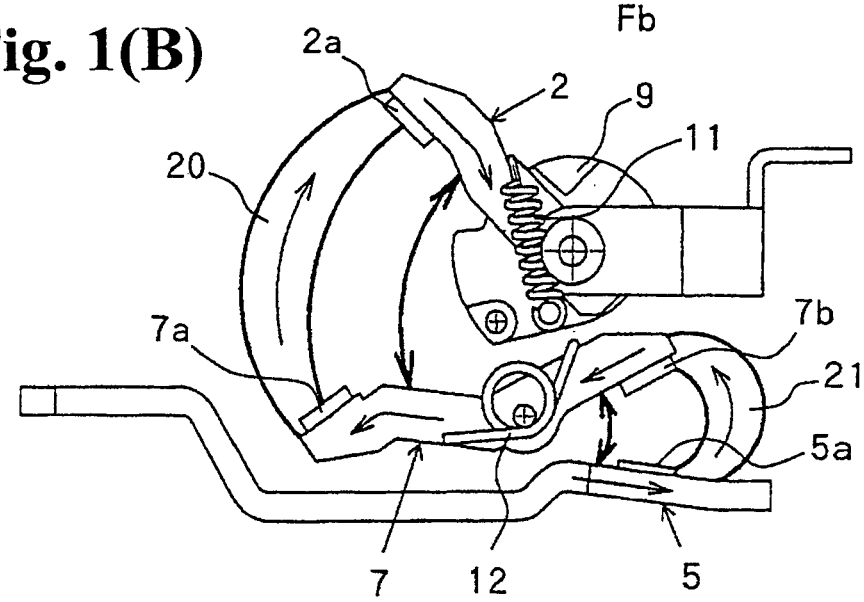
Figure 2:
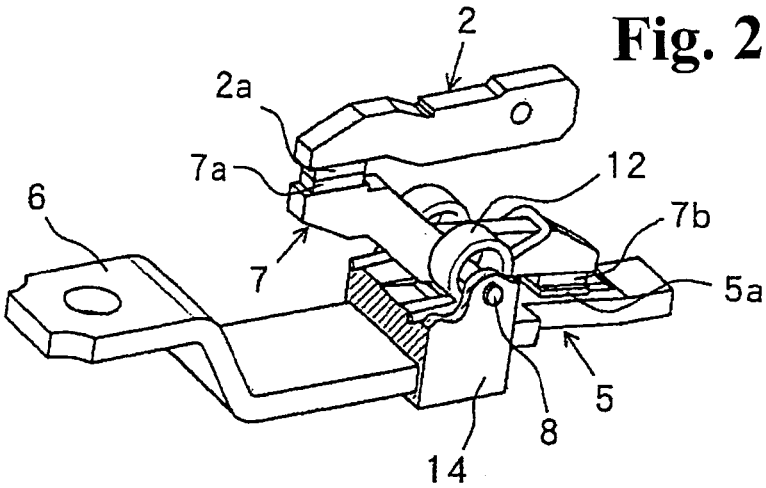
FIG. 2 is a perspective view of the contactor device shown in FIGS. 1A and 1B.
Figure 3:
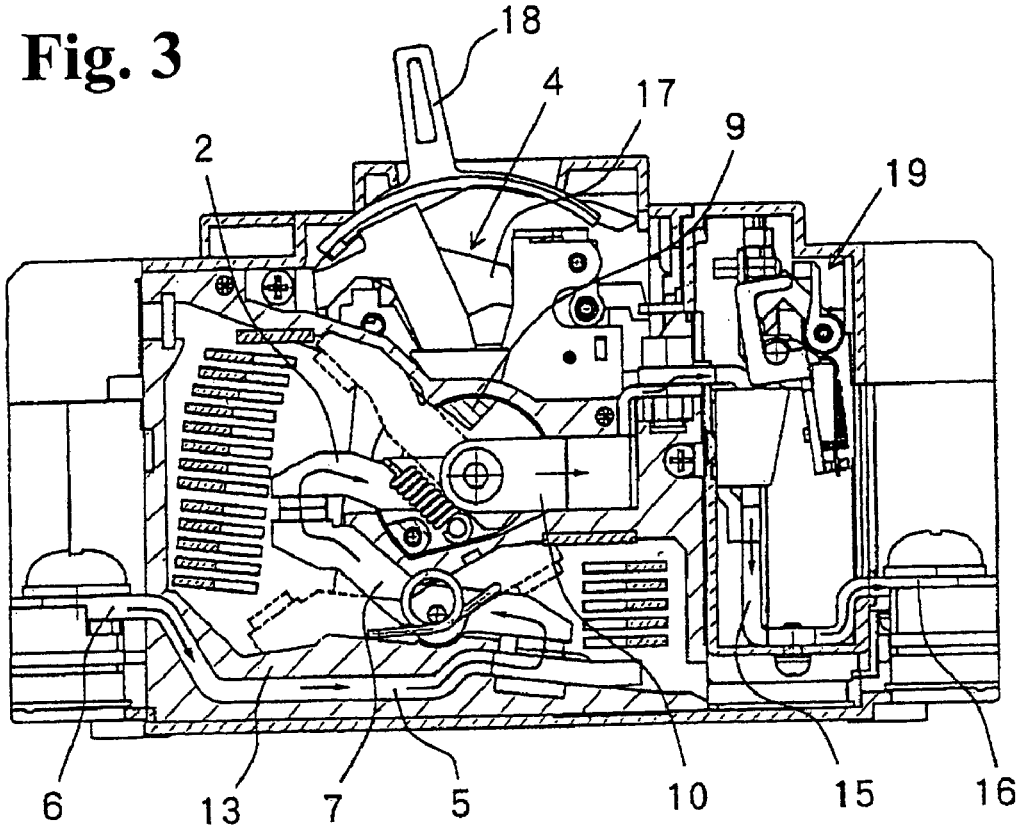
FIG. 3 is a vertical sectional view of a circuit breaker having the contactor device shown in FIGS. 1A and 1B.

Hereunder, embodiments of the present invention will be described with reference to the accompanying drawings. FIGS. 1A and 1B are views showing a contactor device according to an embodiment of the present invention, wherein FIG. 1A is a side view thereof in a closed state and FIG. 1B is a side view thereof in an open state. FIG. 2 is a perspective view of the contactor device shown in FIGS. 1A and 1B. FIG. 3 is a vertical sectional view of a circuit breaker (molded case breaker) having the contactor device shown in FIGS. 1A and 1B.

As shown in FIGS. 1A, 1B and 2, a contactor device 1 is provided with a first movable contactor 2, a fixed contactor 5, and a second movable contactor 7. The first movable contactor 2 has a movable contact 2*a* at one end thereof (left end in FIG. 1B), and is rotatably supported by a supporting point shaft 3 at the other end thereof (right end in FIG. 1B). An open-close mechanism 4 drives the first movable contactor 2 to open and close (see FIG. 3). The fixed contactor 5 has a fixed contact 5*a* at one end thereof (right end in FIG. 1B) and an integral terminal 6 at the other end thereof (left end in FIG. 1B). The second movable contactor 7 has a first movable contact 7*a* for contacting the movable contact 2*a* of the first movable contactor 2 at one end thereof (left end in FIG. 1B), and a second movable contact 7*b* for contacting the fixed contact 5*a* of the fixed contactor 5 at the other end thereof (right end in FIG. 1B). The second movable contactor 7 is rotatably supported on a supporting point shaft 8 located between the first movable contact 7*a* and the second movable contact 7*b*. As shown in the figures, the first movable contactor 2, the fixed contactor 5, and the second movable contactor 7 are arranged in an S-shape.

A holder 9 made of an insulation material and integrated with both poles constitutes the open-close mechanism 4, and supports the first movable contactor 2. The supporting point shaft 3 penetrates through both of the first movable contactor 2 and the holder 9, and is movably supported with a forked support conductor 10 slidably contacting side surfaces of the first movable contactor 2 from outside. A contact spring 11 formed of a helical extension spring is stretched between the first movable contactor 2 and the holder 9 for urging the first movable contactor 2 counterclockwise in FIG. 1B toward the second movable contactor 7. The open-close mechanism 4 drives the first movable contactor 2 about the supporting point shaft 3 via the holder 9 to open and close.

A contact spring 12 formed of a torsion spring is attached to the supporting point shaft 8 for urging the second movable contactor 7 clockwise in FIG. 1 toward the first movable contactor 2 and the fixed contactor 5. One end of the contact spring 12 is hooked on a side of the movable contact 7*b* of the second movable contactor 7 and the other end is hooked on a case 13 of the circuit breaker (see FIG. 3). As shown in FIG. 2, the supporting point shaft 8 of the second movable contactor 7 is held by a holding member 14 integrated with the case 13.

In the closed state shown in FIG. 3, a current flows as indicated by arrows from a power source side terminal 6 to a load side terminal 16 via the fixed contactor 5, the second movable contactor 7, the first movable contactor 2, the support conductor 10, and a relay conductor 15. The open-close mechanism 4 has a known structure in which the holder 9 is driven to open and close via a toggle link (not shown) disposed between the holder 9 and a latch 17 (refer to Japanese Patent Publication (Kokai) No. 04-19938, for example). When a handle 18 is operated to open and close and an over-current tripping device 19 is activated due to a large current such as a short-circuit current, the latch 17 is disengaged and the first movable contactor 2 is driven to open via the holder 9 through energy stored in a main spring (not shown). In this case, in the repulsion-type circuit breaker, as described below, an electromagnetic repulsive force causes the first movable contactor 2 and the second movable contactor 7 to perform an opening action before the action of the open-close mechanism 4.

More specifically, a current flows as indicated by arrows in FIG. 1A. The current flows between the first movable contactor 2 and the second movable contactor 7 in a direction opposite to that between the fixed contactor 5 and the second movable contactor 7, thereby generating the electromagnetic repulsive force. When a large current such as a short-circuit current flows and the electromagnetic repulsive force becomes larger than the forces of the contact springs 11 and 12, the first movable contactor 2 and the second movable contactor 7 are moved instantaneously against the contact springs 11 and 12 and are opened as shown in FIG. 1B before the open-close mechanism 4 is activated. As a result, arcs 20 and 21 extend between the contacts 2*a* and 7*a* and between the contacts 5*a* and 7*b*, respectively, thereby performing current limitation due to increased arc voltages. Subsequently, the open-close mechanism 4 drives the holder 9, so that the first movable contactor 2 is held at the open position even after the electromagnetic repulsive force disappears.

In the embodiment, the electromagnetic repulsive force is generated with the currents flowing between the first movable contactor 2 and the second movable contactor 7 and between the fixed contactor 5 and the second movable contactor 7. Further, the first movable contactor 2, the second movable contactor 7, and the fixed contactor 5 are arranged in the S-shape. Accordingly, the electromagnetic repulsive force is generated also on parallel conductor portions near the contacts 2*a* and 7*a* and parallel conductor portions near the contacts 5*a* and 7*b*, thereby increasing the opening drive force.

As shown in FIG. 1A, the supporting point shaft 8 as the rotational supporting point of the second movable contactor 7 is located closer to the second movable contact 7*b* than the first movable contact 7*a* between the first movable contact 7*a* and the second movable contact 7*b*. Therefore, when the contact spring 12 generates contact forces Fa and Fb, the contact force Fb at a side of the second movable contact 7*b* is stronger than the contact force Fa at a side of the first movable contact 7*a* (Fa<Fb). Accordingly, when the handle 18 is operated to close the first movable contactor 2 (see FIG. 3), it is possible to prevent the second movable contact 7*b* from rotating counterclockwise and moving upwardly away from the fixed contact 5*a* due to an impact of the movable contact 2*a* on the first movable contact 7*a*. If the second movable contact 7*b* lifts away from the fixed contact 5*a*, an arc would be generated, thereby wearing the contacts 5*a* and 7*b*.

As shown in FIG. 1A, as another measure for preventing the second movable contact 7*b* from moving upwardly away from the fixed contact 5*a*, the second movable contactor 7 may be provided with an auxiliary contact spring 22 for pressing the second movable contact 7*b* of the second movable contactor 7 against the fixed contact 5*a*. In addition, the rotational supporting point of the second movable contactor 7 may be located at the center between the first movable contact 7*a* and the second movable contact 7*b*, i.e. the center of gravity of the second movable contactor 7. Accordingly, it is possible to reduce the moment of inertia of the second movable contactor 7, thereby opening with the electromagnetic repulsive force at a higher speed and improving breaking performance.

In the contactor device 1 according to the embodiment, the first movable contactor 2 has the movable contact 2*a* at the one end thereof, and is supported rotatably at the other end thereof. Accordingly, when the open-close mechanism 4 drives the first movable contactor 2 to open and close, the load of the open-close mechanism 4 is reduced. Further, the fixed contactor 5 facing the second movable contact 7*b* of the second movable contactor 7 is not rotated, thereby making the contactor device 1 simple and reducing a height.

Figure 4:
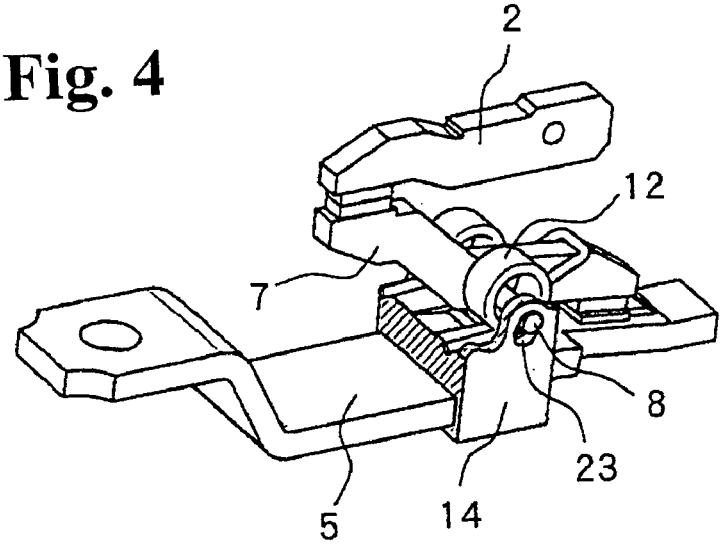
FIG. 4 is a perspective view of a contactor device according to another embodiment of the invention.
Figure 5:
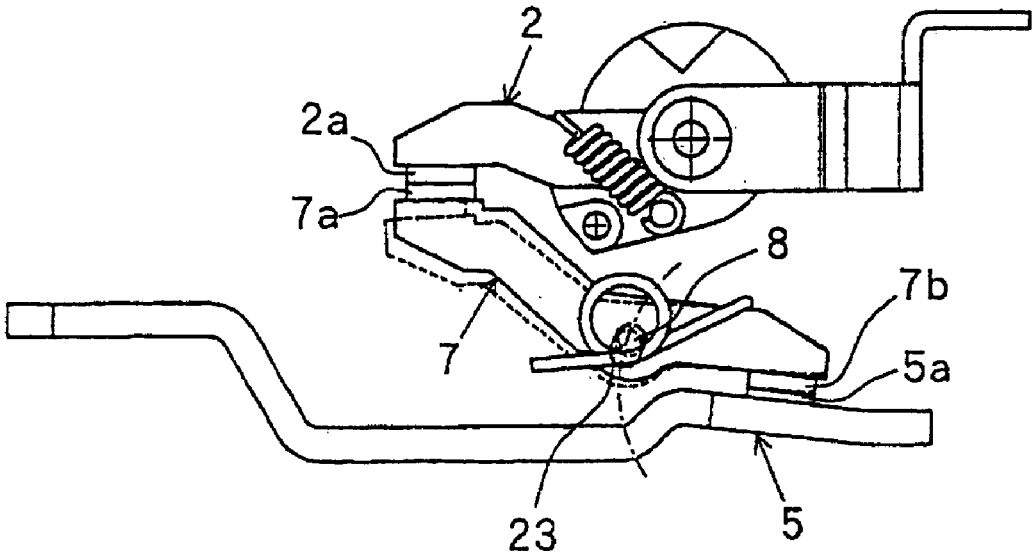
FIG. 5 is a side view showing an operation of the contactor device shown in FIG. 4.

FIG. 4 is a perspective view of a contactor device according to another embodiment of the invention. FIG. 5 is a side view showing an operation of the contactor device shown in FIG. 4. In the embodiment, the supporting point shaft 8 supports the second movable contactor 7, and is held in long holes 23. More specifically, as shown in FIG. 4, the long holes 23 are formed in the holding member 14 and extend along a circular arc passing through the supporting point shaft 8 around the second movable contact 7*b* as the center as shown in FIG. 5. The supporting point shaft 8 is loosely held so as to be movable in the long holes 23. As shown in FIG. 5, when an impact is imposed on the second movable contactor 7 from the first movable contactor 2 when the circuit breaker is closed in a normal operation, the supporting point shaft 8 is moved in the long holes 23 along the circular arc and the second movable contactor 7 is rotated about the second movable contact 7*b* as the supporting point (indicated by a broken line). As a result, the impact is absorbed and the second movable contact 7*b* is prevented from moving upwardly away from the fixed contact 5*a*.

The disclosure of Japanese Patent Application No. 2004-042299, filed on Feb. 19, 2004, is incorporated in the application.

While the invention has been explained with reference to the specific embodiments of the invention, the explanation is illustrative and the invention is limited only by the appended claims.

What is claimed is:

1. A contactor device for a repulsion circuit breaker, comprising:

a first movable contactor having a first movable contact at one end thereof and rotatably supported with the other end thereof as a supporting point so that the first movable contactor is opened and closed by an open-close mechanism, a fixed contactor having a fixed contact at one end thereof and a terminal at the other end thereof, a second movable contactor disposed between the first movable contactor and the fixed contactor, and having a second movable contact for contacting the first movable contact at one end thereof and a third movable contact for contacting the fixed contact at the other end, said second movable contactor being rotatably supported between the second movable contact and the third movable contact, a first contact spring for urging the first movable contactor toward the second movable contactor, and a second contact spring for urging the second movable contactor toward the first movable contactor and the fixed contactor.

2. A contactor device for a repulsion circuit breaker according to claim 1, wherein said first and second movable contactors and said fixed contactor are arranged such that when an over-current flows, an electromagnetic repulsive force is generated so that the first and second movable contactors are rotated against the first and second contact springs to open between the first movable contact and the second movable contact and between the fixed contact and the third movable contact before the open-close mechanism opens the first movable contact.

3. A contactor device for a repulsion circuit breaker according to claim 1, wherein said first movable contactor, said second movable contactor, and said fixed contactor are arranged in an S-shape.

4. A contactor device for a repulsion circuit breaker according to claim 1, wherein said second movable contactor has a rotational supporting point at a center area between the second movable contact and the third movable contact.

5. A contactor device for a repulsion circuit breaker according to claim 1, wherein said second movable contactor has a rotational supporting point at an area close to the third movable contact between the second movable contact and the third movable contact.

6. A contactor device for a repulsion circuit breaker according to claim 1, further comprising a holding member having an elongated hole for supporting the second movable contactor, said second movable contactor having a supporting shaft supported in the elongated hole, said elongated hole extending along a circular arc passing around the third movable contact and loosely holding the supporting shaft.

7. A contactor device for a repulsion circuit breaker according to claim 1, further comprising an auxiliary contact spring for pressing the third movable contact against the fixed contact.

* * * * *